United States Patent [19]

Koike

[11] 3,993,476

[45] Nov. 23, 1976

[54] ALUMINUM ALLOY

[75] Inventor: Keiichi Koike, Matsudo, Japan

[73] Assignee: Hitachi, Ltd., Japan

[22] Filed: Feb. 12, 1975

[21] Appl. No.: 549,287

[30] Foreign Application Priority Data

Feb. 20, 1974 Japan ..... 49-19511

[52] U.S. Cl. ..... 75/141; 75/146; 148/32.5; 148/159

[51] Int. Cl.[2] ..... C22C 21/10

[58] Field of Search ..... 75/141, 146; 148/32, 148/32.5, 159

[56] References Cited

UNITED STATES PATENTS

| | | | |
|---|---|---|---|
| 2,245,167 | 6/1941 | Stroup | 75/141 |
| 3,198,676 | 8/1965 | Sprowls et al. | 148/32.5 |
| 3,794,531 | 2/1974 | Markworth et al. | 75/141 |

*Primary Examiner*—R. Dean

*Attorney, Agent, or Firm*—Craig & Antonelli

[57] ABSTRACT

A castable strong aluminum (Al)-zinc(Zn)-magnesium (Mg) alloy having good mechanical strength, no heat checks produced and improved castability has been provided by lowering the zinc content and increasing the magnesium content than those in prior aluminum-zinc-magnesium alloys.

5 Claims, 1 Drawing Figure

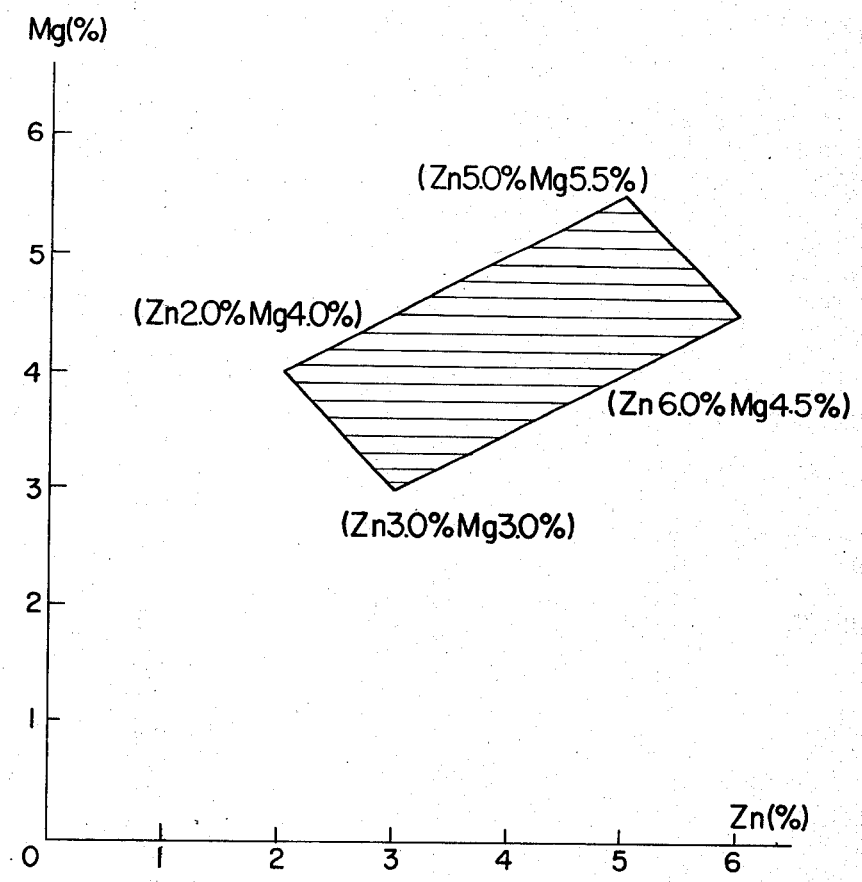
Mg(%)
6
5
4
3
2
1
0
(Zn5.0%Mg5.5%)
(Zn2.0%Mg4.0%)
(Zn 6.0% Mg4.5%)
(Zn3.0%Mg3.0%)
Zn(%)
1
2
3
4
5
6

ALUMINUM ALLOY

The present invention relates to an aluminum alloy which is usable as cast parts such as impellers of a compressor, blower or the like, power transmitting rods or arms which are subject to great force or oil pressure cylinders which are subject to high pressure.

It is well known that aluminum alloys are used as various cast parts, but recent higher speed or higher pressure has required aluminum alloys having higher mechanical strength.

For example, with a material for impellers of a compressor or blower, mechanical properties such as a tensile strength of not less than 40 Kgs/mm² and an elongation of not less than 5% are required and at the same time improved castability is desired. Further, with a material for power transmitting rods or arms, or an oil pressure cylinder, good mechanical properties are similarly required and less defects in a casting are desired.

As materials for such parts as mentioned above, Al-Si-Mg alloys (for example, AC4A, AC4C, A355, and etc.) which are relatively good in castability have hitherto been used in many cases.

However, the tensile strength and elongation of these Al-Si-Mg alloys after the heat treatment (solution-aging) were only about 32 Kgs/mm² and about 5%, respectively.

Further, as alloys which have higher mechanical properties than those of said Al-Si-Mg alloys, Al-Zn-Mg alloys or Al-Cu-Mg alloys are known, but these alloys are generally bad in castability, produce heat checks during casting and, in addition, have often shrinkage cavities or microporosities due to lower fluidity.

On the other hand, one of the Al-Zn-Mg alloys which were improved in many respects was disclosed by Japanese Patent Publication No. 4168/74 and it has a tensile strength of not less than 50 Kgs/mm², but the elongation of the alloy is as low as 3% or lower. Thus, it is not usable as a material for such impellers as mentioned above.

The object of the present invention is to provide castable aluminum alloys which have higher mechanical properties than those of prior aluminum alloys, i.e., a tensile strength of not less than 40 Kgs/mm² and an elongation of not less than 5%, and which have a castability which is equal to or higher than that of Al-Si-Mg alloys.

According to the present invention, there is provided a castable strong Al-Zn-Mg alloy containing 2.0 to 6.0% by weight of zinc and 3.0 to 5.5% by weight of magnesium to which 0.5 to 1.5% by weight of copper, 0.05 to 0.5% by weight of chromium and 0.05 to 0.5% by weight of titanium are added, and one or more of 0.05 to 0.3% by weight of antimony, 0.05 to 0.2% by weight of cerium and 0.05 to 0.3% by weight of zirconium may be further added, as desired, the balance being aluminum and incidental impurities, and said alloy having improved mechanical properties such as a tensile strength of not less than 40 Kgs/mm² and an elongation of 5% or more after being subjected to the heat treatment, no heat checks produced and good castability.

The drawing attached hereto graphically shows the relationship between the zinc content and the magnesium content in the aluminum alloy according to the present invention.

The present inventor conducted many experiments varying the content each of the elements of the Al-Zn-Mg alloy to achieve the object mentioned above. As a result, it has been found that an alloy having a lower zinc content and a higher magnesium content compared with prior alloys, a ratio of Zn/Mg being about 1 (weight ratio) said alloy having 0.5 to 1.5% by weight of copper, 0.05 to 0.5% by weight of chromium and 0.05 to 0.5% by weight of titanium further added thereto, has good mechanical properties, no heat checks produced and improved fluidity.

It has been found that aluminum alloys containing zinc and magnesium in amounts indicated by the hatched area in the graph attached hereto (Zn 2.0 to 6.0% and Mg 3.0 – 5.5%) and further 0.5 to 1.5% by weight of copper, 0.05 to 0.5% by weight of chromium and 0.05 to 0.5% by weight of titanium, the balance being aluminum and incidental impurities are preferred.

Further, it has been found that the addition of one or more of 0.05 to 0.3% by weight of antimony, 0.05 to 0.2% by weight of cerium and 0.05 to 0.3% by weight of zirconium to said alloys results in higher tensile strength.

The compositional range of each element is restricted for the following reasons.

Zn and Mg (the hatched area in the graph attached hereto)

Zinc and magnesium are essential for the increase of strength.

In the case that a zinc content is less than 2.0% by weight and at the same time a magnesium content less than 4.0% by weight, or that a zinc content is less than 3.0% by weight and at the same time a magnesium content less than 3.0% by weight, the strength becomes insufficient (a tensile strength is not more than 30 Kgs/mm²). In the case that a zinc content is not less than 5.0% by weight and at the same time a magnesium content not less than 5.5% by weight, or that a zinc content is not less than 6.0% by weight and at the same time a magnesium content not less than 4.5%, the strength is not effectively increased and the elongation is gradually reduced. The compositions within the area (hatched) surrounded by four lines joining points (Zn 2.0%, Mg 4.0%) and (Zn 3.0%, Mg 3.0%), points (Zn 3.0%, Mg 3.0%) and (Zn 6.0%, Mg 4.5%), points (Zn 6.0%, Mg 4.5%) and (Zn 5.0%, Mg 5.5%) and points (Zn 5.0%, Mg 5.5%) and (Zn 2.0% Mg 4.0%) in the graph attached hereto can produce sound castings without causing heat checks. However, the compositions beyond said area, i.e., having a higher zinc content and a higher magnesium content, have produced unsound castings having heat checks therein and less fluidity. For the reason mentioned above, the zinc and magnesium contents are restricted to ranges of 2.0 to 6.0% and 3.0 to 5.5%, respectively, and further to the hatched area shown in the graph attached hereto.

Cu (0.5 to 1.5%)

Copper causes the strength and elongation to be increased when the zinc and magnesium contents are in the area mentioned above, but the strength is not improved and the elongation is lowered at a copper content below 0.5%, and also at a copper content above 1.5%. Thus, the copper content should be restricted to a range of 0.5 to 1.5%.

Cr (0.05 to 0.5%)

Chromium causes crystals to be finely divided and the strength and elongation to be increased, but such advantages are not obtained at a chromium content below 0.05%, and the strength is not effectively improved and the elongation lowered at a chromium content above 0.5%. Thus, the chromium content should be restricted to a range of 0.05 to 0.5%.

Ti (0.05 to 0.5%)

Titanium causes crystals to be finely divided and the strength and elongation to be increased, but such advantages are not obtained at a titanium content below 0.05%, and the strength and elongation are lowered at a titanium content above 0.5%. Thus, the titanium content should be restricted to a range of 0.05 to 0.5%.

Sb (0.05 to 0.3%)

Antimony is necessary to increase the strength and elongation, but such increase is not almost obtained at an antimony content below 0.05% and the formation of heat checks is promoted at an antimony above 0.3%. Thus, the antimony content should be restricted to a range of 0.05 to 0.3%.

Ce (0.05 to 0.2%)

Cerium causes the elongation to be increased, but such advantages are not almost obtained at a cerium content below 0.05% and above 0.2%. Thus, the cerium content should be restricted to a range of 0.05 to 0.2%.

Zr (0.05 to 0.3%)

Zirconium causes the strength and elongation to be increased, but such advantages are not effectively obtained at a zirconium content below 0.05% and there is no improvement in the strength and elongation at a zirconium content above 0.3%. Thus, the zirconium content should be restricted to a range of 0.05 to 0.3%.

EXAMPLE

The aluminum alloys having the compositions reported in TABLE 1 were molten in graphite crucibles, the melts maintained at a temperature of 720° C and these were cast into JIS testing die preheated to a temperature of 150° C. Test pieces were taken out from these castings. The as-cast and heat treated test pieces were determined on the tensile strength, elongation and hardness. The results are reported in TABLE 2.

The heat treatment of these test pieces was carried out by maintaining them at a temperature of 500° C for 16 hours, cooling them in water at a temperature of 70° C and then maintaining them at a temperature of 160° C for 16 hours for the aging hardening.

Further, the restriction test pieces of 58 mm in outside diameter × 38 mm in inside diameter × 15 mm in height were prepared from the alloys reported in TABLE 1. These test pieces were determined on heat checks. The results are reported in TABLE 2.

The heat checks are indicated by the length (mm) of checks produced when the pieces were cast.

Alloys Nos. 1–7 in TABLES 1 and 2 represent prior Al-Zn-Mg alloys, and alloys Nos. 8–13 represent the aluminum alloys of the present invention.

Table 1

| | CHEMICAL COMPOSITIONS (%) | | | | | | | | |
|---|---|---|---|---|---|---|---|---|---|
| No. | Zn | Mg | Cu | Ti | Cr | Sb | Ce | Zr | Al |
| 1 | 3.0 | 3.0 | 0.1 | 0.2 | — | — | — | — | Balance |
| 2 | 2.0 | 4.0 | 0.1 | 0.2 | 0.2 | — | — | — | " |
| 3 | 4.0 | 2.0 | 0.1 | 0.2 | 0.2 | — | — | — | " |
| 4 | 5.0 | 5.0 | — | 0.2 | — | — | — | — | " |
| 5 | 4.5 | 1.4 | — | 0.2 | 0.2 | — | — | — | " |
| 6 | 6.5 | 0.8 | — | 0.2 | 0.2 | — | — | — | " |
| 7 | 6.5 | 0.8 | 1.0 | 0.2 | 0.2 | — | — | — | " |
| 8 | 3.0 | 3.0 | 0.5 | 0.2 | 0.2 | — | — | — | " |
| 9 | 2.0 | 4.0 | 1.0 | 0.2 | 0.2 | — | — | — | " |
| 10 | 4.0 | 4.0 | 1.0 | 0.2 | 0.2 | — | — | — | " |
| 11 | 5.0 | 5.0 | 1.0 | 0.2 | 0.2 | — | — | — | " |
| 12 | 4.0 | 4.0 | 1.3 | 0.2 | 0.2 | 0.05 | 0.05 | 0.05 | " |
| 13 | 4.0 | 4.0 | 1.0 | 0.2 | 0.2 | 0.2 | 0.2 | 0.2 | " |

TABLE 2

| | MECHANICAL PROPERTIES | | | | | | |
|---|---|---|---|---|---|---|---|
| | AS CAST | | | HEAT TREATED | | | |
| No. | Tensile Strength (Kg/mm²) | Elongation (%) | Hardness (BHN) | Tensile Strength (Kg/mm²) | Elongation (%) | Hardness (BHN) | Heat Checks (mm) |
| 1 | 28.8 | 10.8 | 88 | 34.5 | 15.0 | 108 | 0 |
| 2 | 27.8 | 13.0 | 90 | 35.0 | 24.0 | 110 | 2 |
| 3 | 26.5 | 18.0 | 92 | 35.5 | 11.0 | 109 | 5 |
| 4 | 20.0 | 2.4 | 110 | 23.0 | 0.6 | 138 | 2 |
| 5 | 26.5 | 21.0 | 86 | 35.8 | 13.7 | 122 | 3 |
| 6 | 25.5 | 20.2 | 83 | 34.6 | 13.5 | 118 | 10 |
| 7 | 25.6 | 7.0 | 90 | 39.5 | 8.5 | 125 | 15 |
| 8 | 30.0 | 6.8 | 98 | 40.0 | 9.4 | 110 | 0 |
| 9 | 31.2 | 14.0 | 105 | 43.4 | 13.0 | 143 | 0 |
| 10 | 38.2 | 3.0 | 120 | 54.5 | 7.2 | 165 | 0 |
| 11 | 34.2 | 13.0 | 125 | 55.2 | 5.6 | 167 | 0 |
| 12 | 37.8 | 2.4 | 125 | 55.6 | 7.0 | 165 | 0 |
| 13 | 38.8 | 2.5 | 129 | 56.1 | 6.8 | 162 | 0 |

TABLE 2 shows that both the prior as-cast and heat treated Al-Zn-Mg alloys have an elongation above 5% except for alloy No. 4, but as low tensile strength as less than 40 Kgs/mm² and there is a marked tendency to result in heat checks when cast. Further, prior alloy No. 7 has considerably good mechanical properties such as a tensile strength of 39.5 Kgs/mm² and an elongation of 8.5% after heat treated, but it has a great number of heat checks when cast.

As mentioned above, any of the prior Al-Zn-Mg alloys are not suitable for use in impellers of a compressor, blower or the like, power transmitting rods or arms, or oil pressure cylinders.

On the other hand, it has been found that alloys Nos. 8–13 of the present invention have good mechanical properties such as a tensile strength of 40 Kgs/mm² or more and an elongation of more than 5%. Further, it has been found that the alloys of the present invention have no heat checks and good castability, and that the addition of antimony, cerium and/or zirconium causes the strength to be still further improved.

Thus, it should be understood that the aluminum alloys are suitable for use in impellers of a compressor, blower or the like, power transmitting rods or arms or oil pressure cylinders.

Further, it has been found that the most preferable properties are obtained by the compositions containing 3.0 to 4.0% by weight of zinc and 3.0 to 4.0% by weight of magnesium, the ratio of zinc/magnesium being in vicinity of 1.0 (ranging from 0.9 to 1.1), additionally containing 0.8 to 1.0% by weight of copper, 0.2% by weight of chromium and 0.2% by weight of titanium, the balance being aluminum and incidental impurties, and further that the highest strength is achieved by the compositions still additionally containing one or more of 0.2% by weight of antimony, 0.1 to 0.2% by weight of cerium and 0.2% by weight of zirconium besides the above-mentioned elements.

To the alloys of the present invention there may be added beryllium in a small amounts (about 0.005 – 0.3%) to prevent said alloys from being oxidized. In this case, beryllium has no adverse effects on the properties of the alloys but rather causes the crystals of the alloys to be finely divided and the strength and elongation of the alloys to be increased.

What is claimed is:

1. A castable strong aluminum alloy consisting essentially of, by weight, 2.0 – 6.0% zinc and 3.0 – 5.5% magnesium, the zinc and magnesium being present in amounts indicated by the hatched area in the drawing, and 0.5 – 1.5% copper, 0.05 – 0.5% chromium and 0.05 – 0.5% titanium, said alloy additionally containing two or more of, by weight, 0.05 – 0.3% antimony, 0.05 – 0.2% cerium and 0.05 – 0.3% zirconium, the balance being aluminum and incidental impurities.

2. The castable strong aluminum alloy according to claim 1, which additionally contains 0.005 – 0.3% by weight of beryllium.

3. A castable strong aluminum alloy consisting essentially of, by weight, 2.0 – 6.0% zinc and 3.0 – 5.5% magnesium, the zinc and magnesium being present in amounts indicated by the hatched area in the drawing, and 0.5 – 1.5% copper, 0.05 – 0.5% chromium, 0.05 – 0.5% titanium, and 0.05 – 0.3% antimony, the balance being aluminum and incidental impurities.

4. The castable strong aluminum alloy according to claim 3, which additionally contains, by weight, 0.05 to 0.2% cerium.

5. A castable strong aluminum alloy consisting essentially of, by weight, 2.0 – 6.0% zinc and 3.0– 5.5% magnesium, the zinc and magnesium being present in amounts indicated by the hatched area in the drawing, and 0.5 – 1.5% copper, 0.05 – 0.5% chromium, 0.05 – 0.5% titanium, and 0.05 – 0.2% cerium, the balance being aluminum and incidental impurities.

* * * * *